US006088892A

United States Patent [19]

Bertsch et al.

[11] Patent Number: 6,088,892

[45] Date of Patent: Jul. 18, 2000

[54] METHOD OF AERODYNAMIC TEXTURING, TEXTURING NOZZLE, NOZZLE HEAD AND USE THEREOF

[75] Inventors: Gotthilf Bertsch, Ebnat-Kappel; Erwin Schwarz, Ulisbach, both of Switzerland

[73] Assignee: Heberlein Fibertechnology, Inc., Wattwill, Switzerland

[21] Appl. No.: 08/930,190

[22] PCT Filed: Feb. 12, 1997

[86] PCT No.: PCT/CH97/00045

§ 371 Date: Feb. 25, 1998

§ 102(e) Date: Feb. 25, 1998

[87] PCT Pub. No.: WO97/30200

PCT Pub. Date: Aug. 21, 1997

[30] Foreign Application Priority Data

Feb. 15, 1996 [DE] Germany ..... 196 05 675

[51] Int. Cl.[7] ..... D02J 1/08; D02G 1/16

[52] U.S. Cl. ..... 28/273; 28/276; 28/254

[58] Field of Search ..... 28/254, 271, 273, 28/274, 276, 272, 275; 57/333, 350, 908

[56] References Cited

U.S. PATENT DOCUMENTS

| | | | |
|---|---|---|---|
| 2,958,112 | 11/1960 | Hall . | |
| 3,093,878 | 6/1963 | Fieldman et al. . | |
| 3,474,613 | 10/1969 | Joarder et al. . | |
| 3,525,134 | 8/1970 | Coon | 28/1.4 |
| 3,638,291 | 2/1972 | Yngve . | |
| 3,751,767 | 8/1973 | Marshall | 19/0.58 |
| 3,754,694 | 8/1973 | Reba | 28/272 |
| 3,822,543 | 7/1974 | Edagawa et al. . | |

(List continued on next page.)

FOREIGN PATENT DOCUMENTS

| | | |
|---|---|---|
| 0 088 254 | 9/1983 | European Pat. Off. . |
| 0 098 354 | 1/1984 | European Pat. Off. . |
| 0 140526 | 5/1985 | European Pat. Off. . |
| 0 189 099 | 1/1986 | European Pat. Off. . |
| 0 441 925 B1 | 4/1994 | European Pat. Off. . |
| 2 856 291 | 3/1980 | Germany . |
| 47-16270 | 5/1972 | Japan . |
| 512975 | 1/1976 | Japan . |
| 839493 | 6/1960 | United Kingdom . |
| 1 178 753 | 4/1968 | United Kingdom . |
| 1 282 148 | 7/1972 | United Kingdom . |
| 2 079 189 | 1/1982 | United Kingdom . |
| 2 178 072 | 2/1987 | United Kingdom . |
| 924089 | 4/1993 | United Kingdom . |
| 2 287 256 | 9/1995 | United Kingdom . |
| 97/11214 | 3/1997 | WIPO . |

OTHER PUBLICATIONS

A Demir, "A Study of Air–Jet Texturing Nozzles: The Effects of Nozzle Configuration on the Air Flow", Transactions of the ASME, Series B: Journal of Engineering for Industry, 112(1) :97–104 (1990).

*Primary Examiner*—Amy B. Vanatta
*Attorney, Agent, or Firm*—Finnegan, Henderson, Farabow, Garrett & Dunner

[57] ABSTRACT

A method of air jet texturing is described wherein the intensity of texturing is proposed to be increased in that an air flow exceeding Mach 2 is obtained by the design of the nozzle duct. The total opening angle of the nozzle duct (11) directly in front of the texturing zone is designed to be greater than the ideal Laval angle with an effective length which is preferably a multiple of the smallest diameter of the nozzle. This predominantly improves the quality of texturing, quite particularly at higher production rates. These can be increased into the range of 600 to 1000 m/min and higher. It has surprisingly been found that the novel nozzle core (10) can be designed so that it has all advantages of the novel invention and can be used as a substitute for prior art nozzle cores. The same applies to the complete texturing head as the novel invention can be used within the same geometric external dimensions, the same air pressure and the same quantity of air.

15 Claims, 12 Drawing Sheets

U.S. PATENT DOCUMENTS

| | | | |
|---|---|---|---|
| 3,828,404 | 8/1974 | Peckinpaugh et al. . | |
| 3,916,493 | 11/1975 | Ethridge . | |
| 3,983,609 | 10/1976 | Pike . | |
| 4,040,154 | 8/1977 | Riley | 28/273 |
| 4,064,686 | 12/1977 | Whitted et al. . | |
| 4,070,815 | 1/1978 | Negishi et al. . | |
| 4,157,605 | 6/1979 | Agers | 28/254 |
| 4,251,904 | 2/1981 | Sano et al. . | |
| 4,507,833 | 4/1985 | Simmen . | |
| 4,535,516 | 8/1985 | Egbers et al. | 28/274 |
| 4,574,436 | 3/1986 | Cullen, Jr. | 28/254 |
| 4,581,886 | 4/1986 | Coll-tortosa | 28/274 |
| 4,633,550 | 1/1987 | McAliley . | |
| 4,641,504 | 2/1987 | Runkel . | |
| 4,691,947 | 9/1987 | Burkhardt et al. . | |
| 4,922,593 | 5/1990 | Gorrafa . | |
| 4,945,618 | 8/1990 | Gorrafa . | |
| 5,003,677 | 4/1991 | Krenzer | 28/254 |
| 5,020,199 | 6/1991 | Gorrafa . | |
| 5,140,729 | 8/1992 | Simmen | 28/274 |
| 5,157,819 | 10/1992 | Hodan . | |
| 5,182,900 | 2/1993 | Horak et al. . | |
| 5,231,743 | 8/1993 | Goldstein . | |
| 5,241,730 | 9/1993 | Simmen et al. | 28/254 |
| 5,511,295 | 4/1996 | Shah . | |
| 5,579,566 | 12/1996 | Burkhardt et al. | 28/254 |
| 5,640,745 | 6/1997 | Bertsch et al. . | |
| 5,713,113 | 2/1998 | Demir . | |

FIG. 3
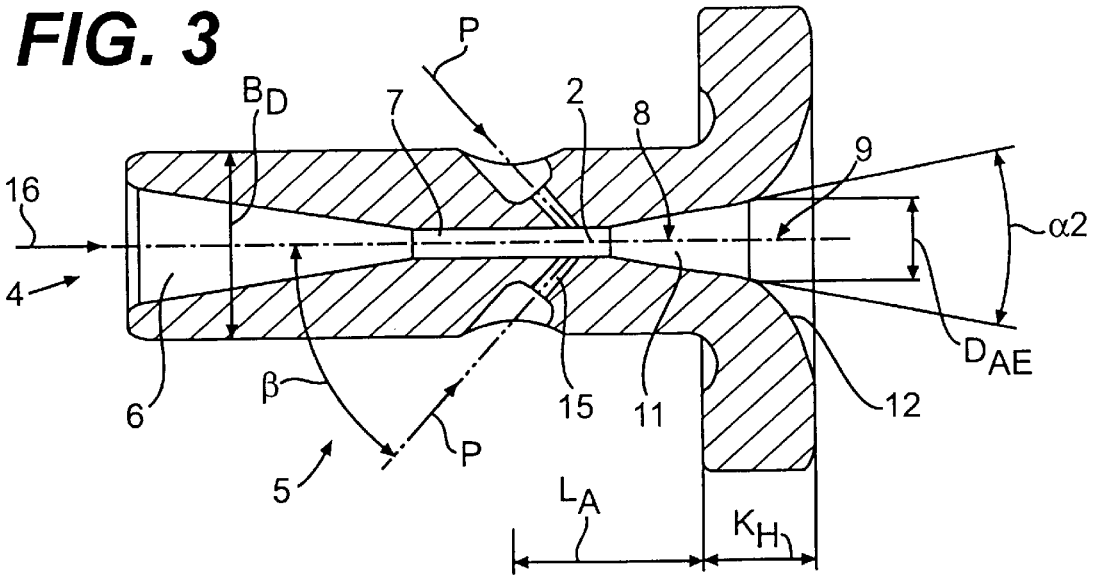
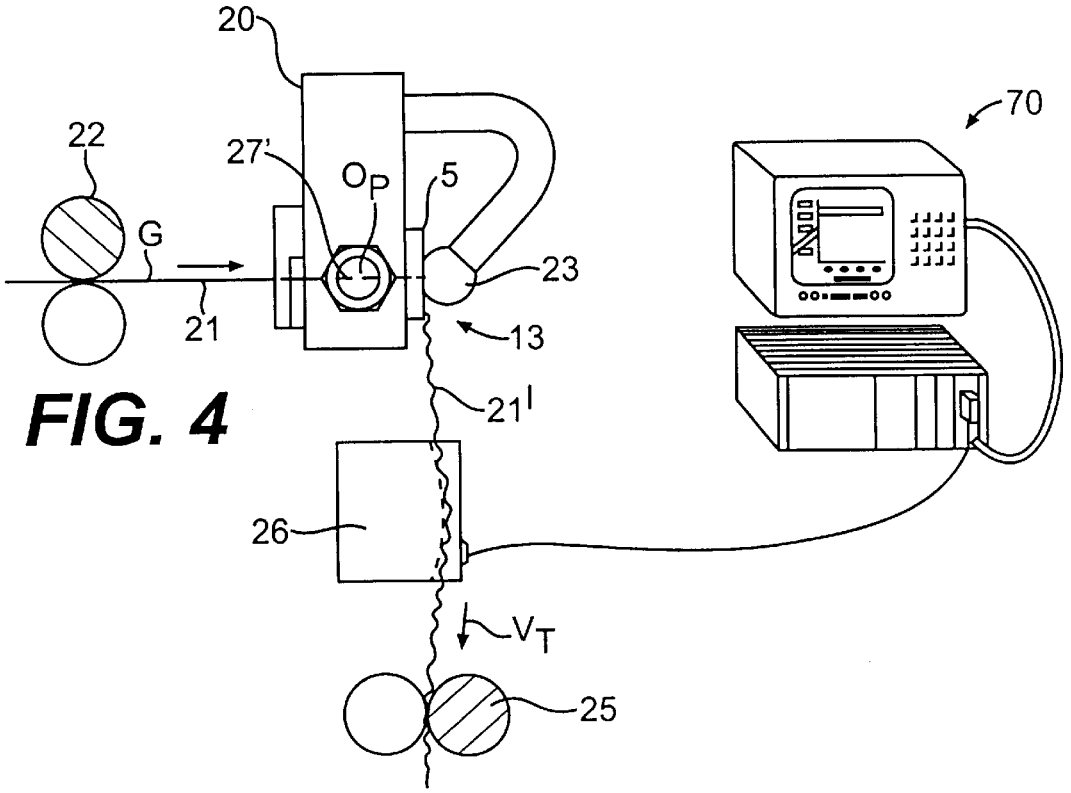
FIG. 4
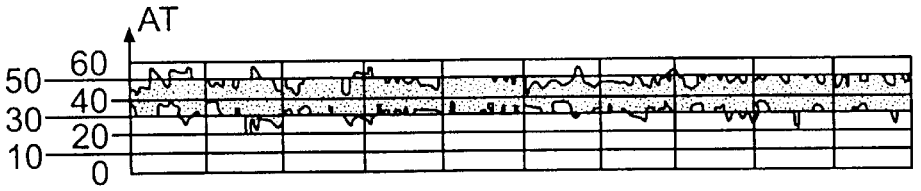
FIG. 4a

FIG. 10

PA 78f51; CORE 10% EFFECT 30%; 9 BAR

MEAN cN

| NOZZLE | V 400m/min | V 500 m/min | V 600 m/min | V 700 m/min | V 800 m/min | V 900 m/min |
|---|---|---|---|---|---|---|
| T 311Z Standard | 5.40 | 5.20 | 4.00 | 0.00 | 0.00 | 0.00 |
| S311Z 19.0° | 7.00 | 7.20 | 7.10 | 7.00 | 6.60 | 0.00 |
| S311Z 20.8° | 6.80 | 6.90 | 6.80 | 6.70 | 6.40 | 0.00 |
| S311Z 22.4° | 7.50 | 7.60 | 7.60 | 7.50 | 7.20 | 0.00 |
| S311Z 24.0° | 6.80 | 6.70 | 6.70 | 6.50 | 6.20 | 0.00 |
| S311Z 26.9° | 7.20 | 7.20 | 7.20 | 7.00 | 6.80 | 0.00 |
| S311Z 28.8° | 7.60 | 7.60 | 7.60 | 7.40 | 7.10 | 0.00 |
| S311Z 29.6° | 7.70 | 7.80 | 7.70 | 7.40 | 0.00 | 0.00 |
| S311Z 30.6° | 7.60 | 7.60 | 7.60 | 7.40 | 0.00 | 0.00 |

SIGMA %

| NOZZLE | V 400 m/min | V 500 m/min | V 600 m/min | V 700 m/min | V 800 m/min | V 900 m/min |
|---|---|---|---|---|---|---|
| T 311Z Standard | 8.50 | 10.10 | 10.30 | 0.00 | 0.00 | 0.00 |
| S311Z 19.0° | 6.30 | 6.60 | 6.10 | 7.60 | 9.30 | 0.00 |
| S311Z 20.8° | 5.70 | 6.10 | 5.80 | 7.10 | 8.00 | 0.00 |
| S311Z 22.4° | 6.10 | 6.50 | 6.50 | 8.20 | 9.40 | 0.00 |
| S311Z 24.0° | 5.70 | 6.40 | 6.10 | 7.80 | 8.50 | 0.00 |
| S311Z 26.9° | 5.90 | 6.50 | 6.40 | 8.30 | 9.20 | 0.00 |
| S311Z 28.8° | 6.40 | 7.00 | 7.00 | 8.40 | 10.00 | 0.00 |
| S311Z 29.6° | 6.20 | 7.40 | 7.20 | 8.20 | 0.00 | 0.00 |
| S311Z 30.6° | 6.10 | 6.40 | 6.20 | 8.10 | 0.00 | 0.00 |

AT VALUE

| NOZZLE | V 400m/min | V 500 m/min | V 600 m/min | V 700 m/min | V 800 m/min | V 900 m/min |
|---|---|---|---|---|---|---|
| T 311Z Standard | 18.30 | 26.50 | 31.30 | 0.00 | 0.00 | 0.00 |
| S311Z 19.0° | 8.00 | 9.60 | 8.30 | 13.00 | 20.20 | 0.00 |
| S311Z 20.8° | 7.50 | 8.50 | 7.80 | 11.50 | 16.10 | 0.00 |
| S311Z 22.4° | 8.00 | 9.10 | 9.20 | 14.50 | 19.50 | 0.00 |
| S311Z 24.0° | 7.50 | 9.60 | 8.70 | 14.10 | 17.40 | 0.00 |
| S311Z 26.9° | 7.60 | 9.40 | 9.10 | 15.50 | 19.40 | 0.00 |
| S311Z 28.8° | 8.90 | 10.50 | 10.60 | 15.30 | 22.40 | 0.00 |
| S311Z 29.6° | 8.30 | 10.90 | 11.00 | 14.70 | 0.00 | 0.00 |
| S311Z 30.6° | 7.90 | 8.80 | 7.90 | 14.50 | 0.00 | 0.00 |

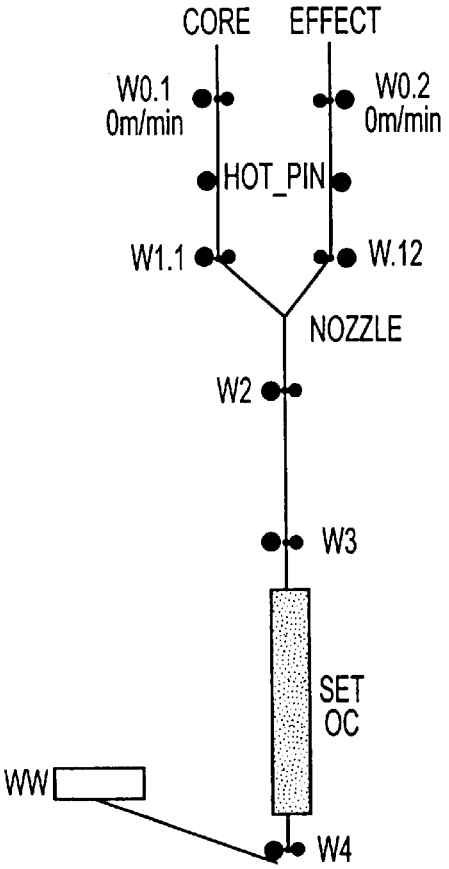

FIG 12

| | | |
|---|---|---|
| **TEXTURING** | | |
| NOZZLE CORE | | S3157 |
| PRESSURE BAR | | 9 |
| YARN MOISTENING 1/h | | 2 |
| PK DISTANCE mm | | 3.8 |
| **TEXTURING ZONE** | | |
| W1.1 | OFc% | 12 |
| | M/MIN | 784 |
| W1.2 | OFef% | 30 |
| | M/MIN | 910 |
| W2 PILOT M/MIN (100%) | | 700 |
| **STABILIZATION ZONE** | | |
| W3 | M/MIN | 700 |
| | % v. W2 | 0 |
| **HEATING ZONE-SET** | | |
| W4 | M/MIN | 700 |
| | % v. W3 | 0 |
| SET-TEMP °C | | |
| **WINDING** | | |
| WW | M/MIN | 756 |
| | % v. W4 | 8 |
| **YARN TENSILE FORCES** | | |
| F_2cN AFTER NOZZLE | | 5.9 |
| F_3cN STABILIZATION ZONE | | |
| F_4cN PRIOR TO SET | | |
| F_5cN PRIOR TO WW | | |
| ATQ AT-VALUE | | 27 |
| **YARN TEST** | | |
| THEORETICAL TITRE dtex | | |
| ACTUAL TITRE dtex | | 170 |
| ELONGATION AT BREAK % | | 32.7 |
| TENSILE STRENGTH cN/dtex | | 3.49 |
| ABSOLUTE STRENGTH gr | | 593 |

FIG 12C

| | | |
|---|---|---|
| **TEXTURING** | | |
| NOZZLE CORE | T311K | T311K |
| PRESSURE BAR | 9 | 9 |
| YARN MOISTENING 1/h | 2 | 2 |
| PK DISTANCE mm | 3.8 | 3.8 |
| **TEXTURING ZONE** | | |
| W1.1 OFc% | 12 | 12 |
| M/MIN | 560 | 784 |
| W1.2 OFef% | 30 | 30 |
| M/MIN | 650 | 910 |
| W2 PILOT M/MIN (100%) | 500 | 700 |
| **STABILIZATION ZONE** | | |
| W3 M/MIN | 500 | 700 |
| % v. W2 | | |
| **HEATING ZONE-SET** | | |
| W4 M/MIN | 500 | 700 |
| % v. W3 | | |
| SET-TEMP °C | | |
| **WINDING** | | |
| WW M/MIN | 535 | 756 |
| % v. W4 | 7 | 8 |
| **YARN TENSILE FORCES** | | |
| F_2cN AFTER NOZZLE | 4.2 | 2.9 |
| F_3cN STABILIZATION ZONE | | |
| F_4cN PRIOR TO SET | | |
| F_5cN PRIOR TO WW | | |
| ATQ AT-VALUE | 23 | 46 |
| **YARN TEST** | | |
| THEORETICAL TITRE dtex | | |
| ACTUAL TITRE dtex | 170 | 170 |
| ELONGATION AT BREAK % | 26.2 | 23.5 |
| TENSILE STRENGTH cN/dtex | 2.99 | 2.84 |
| ABSOLUTE STRENGTH gr | 507 | 483 |

FIG 12A
PRIOR ART

FIG 12B
PRIOR ART

METHOD OF AERODYNAMIC TEXTURING, TEXTURING NOZZLE, NOZZLE HEAD AND USE THEREOF

TECHNICAL FIELD

The invention relates to a method for the aerodynamic texturing of yarn with a texturing nozzle having a continuous yarn duct, at one end of which the yarn is supplied and at the other end is delivered as textured yarn, compressed air being supplied into the yarn duct at a supply pressure higher than 4 bar in a central portion and the air jet being accelerated to supersonics in a widening acceleration duct. The invention also relates to a texturing nozzle, a nozzle head and its use, with a continuous yarn duct having a compressed air supply, on one side of which yarn can be supplied and on the other side of which texturing can be carried out.

STATE OF THE ART

Two types of texturing nozzle have proved successful in air jet texturing technology. They differ according to the type of compressed air supply into the yarn duct. One is the air jet texturing nozzle operating by the radial principle. The compressed air is supplied via one or more predominantly radially arranged air ducts, for example according to EP-PS 88 254. Texturing nozzles operating by the radial principle are used mainly with yarns requiring rather low excess deliveries lower than 100%. In special cases, with so-called effect yarns, an excess delivery of up to 200% can be permitted briefly. The second type involves the axial principle. The compressed air is guided here via axially directed ducts into an enlarged chamber of the yarn duct. A solution of this type is shown in EP-PS 441 925. Texturing nozzles operating by the axial principle are successfully used mainly with very high excess deliveries of up to 300% and sometimes even up to 500%. The two practical solutions differ in particular by the design of the nozzle aperture in the region of the nozzle outlet. The solution according to EP-PS 441 925 has a nozzle aperture corresponding to a Laval nozzle in front of the outlet end. The Laval nozzle is characterised by a very small opening angle of a maximum of 8° to 10°. If the opening angle is equal to or smaller than the so-called ideal Laval angle, the air speed in the nozzle aperture can be increased smoothly beyond the sound limit, providing the air pressure is above a critical pressure ratio at the narrowest point of the Laval nozzle. Laval noticed that the limit zone of the increase in speed shifts into the nozzle even in an ideal nozzle when the air pressure is reduced. A shock wave with the known compression surges can form. Compression surges are avoided whenever possible in most specialist fields in fluid mechanics. The texturing process is more complex since not only a supersonic flow with a gas is required but the yarn simultaneously also has to be guided centrally through the nozzle and processed by the shock wave. To compensate all losses of flow, air pressures higher than 4 bar and usually higher than 6 bar are used during air jet texturing. The theoretical maximum speed of the air (at a temperature of 20° C., a preliminary pressure tending to infinity and an ideal Laval angle lower than 10°) is about 770 m/sec. In reality, the maximum possible air speed at 12 bar is between 500 and 550 m/sec, that is lower than Mach 2. Reference is made to a scientific investigation in "Chemiefasern/Textilindustrie" May 1981. According to the most widely adopted specialist opinion, the texturing process as such is due to the effect of the compression surges which are a phenomenon of the supersonic flow. The yarn textured with a texturing nozzle having an ideal Laval angle could now be taken as a gauge of quality. Other nozzle shapes could be sought on the basis of this given quality. According to EP-PS 88 254, the applicants actually achieved an alternative nozzle shape with a trumpet-shaped nozzle mouth, the so-called Hemajet nozzle. The trumpet shape appears to lie outside Laval's laws only at first sight. A second investigation (International Textile Bulletin Yarn Production 3/83) revealed that a supersonic flow is also produced with the trumpet shape, maximum air speeds having been measured in the range of about 400 m/sec. It has also been found in the practice of yarn finishing that the trumpet shape is more advantageous in particular spheres of application. The Hemajet nozzle is based on a convexly curved outlet aperture which can be described with a simple radius. If the enlargement directly adjoining the narrowest point is checked, it is found that it initially lies in the range of the ideal Laval opening angle for a short distance. This is an important reason why both types of nozzle sometimes give similar texturing results. Both have proved useful as standard nozzles in various applications.

Although texturing nozzles operating by the radial principle are superior to texturing nozzles operating by the axial principle, particularly with low excess deliveries, the above-mentioned article shows that the yarn tension decreases markedly with the radial principle when the over-delivery increases. It is known from experience that the yarn tension directly after the texturing nozzle is a quality feature for texturing. A good comparison of quality (higher/lower values) is simplified if at least 50 m/min, preferably 100 m/min, differences in the production speeds are compared. The term quality covers all possible yarn quality criteria. Production conditions which cannot be measured directly as quality criteria on the textured product but should be considered according to experience are included. For example, pronounced or slight flapping of the entering yarns is a criterion or a value which is not permitted above a specific value. For direct metrological comparison according to the teaching of the invention, the tensile force on the yarn after texturing (in cN or mean cN) and the percentage deviation in the instantaneous tensile force (sigma %) is preferably selected. The two values can be detected separately or as a joint value (AT value). Reference is made to the ATQ measuring and evaluating principle devised by the applicants in collaboration with the company Retech AG, Switzerland. Yarn speeds below 400 m/min do not pose any problems nowadays. In individual practical applications, qualitatively accepted texturing is still achieved at yarn speeds of 400 to 600 m/min. On the other hand, a deterioration in quality is observed during a further increase in the yarn take-off speed to above 600 m/min. This is manifested, for example, in that individual loops project more markedly from the textured yarn in the case of a textured yarn without explanation. Known texturing nozzles can be used only at production rates below 400 m/min, in particular in the case of compact yarns when maximum qualities of texturing are demanded. The term production rate denotes the take-off speed of the yarn from the texturing nozzle. An absolute texturing limit at which texturing breaks down, for example owing to excessive flapping, is therefore known with respect to the production rate in addition to the quality limit during texturing.

DESCRIPTION OF THE INVENTION

An embodiment of the invention aims either to increase the quality of texturing at a given speed or to increase the production rates, for example in the range of 400 to 900 m/min and higher, and to achieve an equally good or at least approximately equally good quality even at higher production rates as at lower production or yarn rates. A further partial aim was to be able to convert existing apparatuses with minimum expenditure, with respect to quality and/or performance.

In one aspect a method according to the invention is characterised in that the yarn tension, in particular as yarn tension which is as constant as possible, is increased in that the air jet in the acceleration duct is accelerated to Mach 2 or higher to optimise the yarn tension to yarn speed ratio.

In another aspect, the invention relates to a texturing nozzle with a continuous yarn duct with an outlet-side acceleration duct and a compressed air supply (P) into the yarn duct, on one side of which yarn can be supplied and on the other side of which textured yarn can be taken off, and characterised in that the accelerating portion of the acceleration duct has a length ($l_2$) greater than 1.5 times the diameter (d) at the beginning of the acceleration duct and a total opening angle ($\alpha_2$) greater than the ideal Laval angle.

It has been found that the first key to quality resides in the yarn tension after the texturing nozzle. The quality can be improved only if the yarn tension is successfully increased. However, the actual breakthrough was first permitted when the flow of the air jet was increased above the range of Mach 2. Contrary to the obvious prejudice in the entire specialist field, this could be constructionally achieved by the design of the acceleration duct according to the invention. It could surprisingly be confirmed by numerous series of tests that not only the quality is improved but also the quality is adversely affected to an amazingly small extent according to the invention by an increase in the production rate. The inventor found that the object could be achieved only by intensifying the texturing process. However, the aim was achieved only with the discovery that the Mach number is a crucial influencing factor. The specialist sphere was formerly fixed too greatly on the flow rate. However, the rate cannot be increased beyond the above-mentioned ranges (below Mach 2) in current textile practice. The prior art was led either by the rules of Laval nozzles or by purely empirically determined shapes of nozzle found to be good. Even a slight increase in the Mach number above 2 produced significant results. The best explanation of the corresponding intensification of the texturing process resides in the fact that the difference in speed is increased directly before and after the shock wave and this directly affects the corresponding forces of action by the air on the filaments. The increased forces in the region of the shock wave increase the yarn tension. The action at the shock wave is increased directly by increasing the Mach number. With the new invention, therefore, the yarn tension could be significantly increased and the quality ensured to an extent not possible hitherto. The following rule: higher Mach number—stronger surge—more intense texturing, has therefore been recognised according to the invention.

The intensified supersonic flow grasps the opened yarn over a broader front and much more intensively. As a result, no loops can escape laterally beyond the zone of action of the shock wave. As the production of the supersonic flow in the acceleration duct is based on expansion, an increase and almost a doubling of the effective outlet cross section is obtained as a result of the higher Mach range, for example Mach 2.5 instead of Mach 1.5. Various surprising observations could be made even with the first series of tests:

when using a supersonic duct designed for the higher Mach range, a qualitative improvement in texturing occurred in each case, in comparison with the prior art, at an identical production rate;

a pronounced gradual loss of quality can be determined with the prior art texturing nozzles when increasing the production rate. Although a loss of quality occurs with the novel texturing nozzles, this only occurred to a slight extent in all tests and was troublesome only at high production rates, for example above 800 m/min, depending on yarn titre;

tests with individual yarn titres were carried out to a production rate of 1000 to 1500 m/min without a breakdown of texturing;

it was immediately noticed metrologically that the yarn tension could be increased by about 50% on average. The increased value also remained almost constant over a great speed range of, for example, 400 to 700 m/min;

it has also certainly been found that the choice of the supply pressure of the compressed air is a significant influencing factor. A higher supply pressure is required in many cases to ensure the higher Mach numbers. This is between about 6 and 14 bar but can be increased to 20 bar and higher.

The comparison tests, state of the texturing art and novel invention proved, in a very wide range, the following rule:

the quality of texturing is at least equal or better with a supersonic duct designed for the lower Mach range at a higher production rate in comparison with the quality of texturing at a lower production rate. The texturing process is so intensive at air speeds in the shock wave higher than Mach 2, for example at Mach 2.5 to Mach 5, that, even at maximum yarn passage speeds, all loops are adequately picked up and bound well in the yarn almost without exception. The generation of an air speed in a high Mach range has two effects within the acceleration duct. Firstly, the individual filaments are opened more markedly and drawn into the nozzle with greater force. Texturing no longer breaks down up to maximum speeds. Secondly, the entire filament assembly is guided uniformly directly into the shock wave zone within clear outer duct limits.

Embodiments of the novel invention also allow a large number of particularly advantageous designs of the method and of the device. Reference is also made here to claims 2 to 10 and 12 to 17. The yarn is drawn in and opened by the accelerating air jet over the corresponding path in the acceleration duct, and transferred to the subsequent texturing zone. A significant point in texturing technology is that once the final processor has found a good quality, he can maintain it without change during further production. The constancy of the uniform quality is often the highest precept. This is achieved particularly well with the novel solution because the factors which are decisive for texturing can be controlled better than in the state of the art. The main point is the control of the yarn tension particularly also with respect to the constancy of the yarn tension and the constancy of the quality of texturing. The compressed air is preferably accelerated in the acceleration duct over a length of at least 1.5, preferably at least 2 times the narrowest diameter, the ratio of outlet to inlet cross section of the acceleration duct being greater than 2. The total opening angle of the air jet should be greater than 10°, that is greater than the ideal Laval angle. The best results were obtained in the past when the acceleration of the air jet was carried out steadily. However, variations with different accelerations have also been investigated. The results were sometimes almost as good as the steady acceleration with a continuously conical acceleration duct. The air jet is then guided to the acceleration duct without deflection through an irregularly and markedly widening portion. One or more yarn filaments can be introduced with identical or different excess delivery and can be textured at a production rate of 400 to above 1200 m/min. The compressed air jet in the supersonic duct is accelerated to 2.0 to 6 Mach, preferably to 2.5 to 4 Mach. The best results were achieved when the outlet end of the yarn duct was limited by a impact member such that the textured yarn is discharged through a gap substantially at right angles to the axis of the yarn duct.

Furthermore, the air jet is particularly preferably guided from the feed point into a cylindrical portion of the yarn duct directly in an axial direction at substantially constant speed to the acceleration duct, the compressed air being introduced into the yarn duct via one or more, preferably three or more orifices or ducts, such that the compressed air is blown at an angle ($\beta$) with a conveying component in the direction of the acceleration duct. Air jet texturing nozzles operating by the radial principle could surprisingly be modified to the novel invention with very good results, that is texturing nozzles according to EP-PS 88 254, of which the technical details are explained as part of this application. The compressed air is preferably introduced into the yarn duct via three orifices such that the compressed air is blown in at a corresponding angle with a conveying component in the direction of the supersonic duct. As in the prior art, one or more yarn filaments can also be textured with the most varied excess delivery with the novel solution. The total theoretically effective widening angle of the supersonic duct from the smallest to the greatest diameter should preferably be greater than 10° but smaller than 40°, preferably within the range of 12 to 30°, particularly preferably 12 to 25°. The currently available roughness values have produced an upper limit angle of 35 to 36°, above which a cessation of the supersonic flow takes place. The compressed air is accelerated substantially steadily in a conical acceleration duct. The nozzle duct portion immediately before the supersonic duct is preferably substantially cylindrical in design, air being blown into the cylindrical portion with a conveying component in the direction to the acceleration duct. The intake force on the yarn is increased with the length of the acceleration duct. The nozzle enlargement or the increase in the Mach number provides the intensity of texturing. The supersonic duct should at least have a cross-sectional enlargement range of 1:2.0 preferably 1:2.5 or greater. It is also proposed that the length of the acceleration duct be 3 to 15 times, preferably 4 to 12 times greater than the diameter of the yarn duct at the beginning of the acceleration duct. The acceleration duct can be enlarged completely or partially steadily, can have conical portions and/or a slightly spherical shape. However, the acceleration duct can also be designed stepwise and can have different acceleration zones with at least one zone with high acceleration and at least one zone with low acceleration of the compressed air jet. The outlet region of the acceleration duct can also be cylindrical or approximately cylindrical and the inlet region markedly widened but widened by less than 36°. If the marginal conditions for the acceleration duct have been maintained according to the invention, said variations in the acceleration duct have proven to be almost equivalent or at least equivalent. Adjacent to the supersonic duct, the yarn duct has a markedly convex yarn duct mouth which is preferably widened by more than 40° in the form of a trumpet, the transition from the supersonic duct into the yarn duct mouth preferably being unsteady. A decisive factor resides in the fact that the pressure conditions in the texturing chamber can be positively influenced and can be kept stable, in particular, with a impact member. A preferred embodiment of the texturing nozzle according to the invention is characterised in that it has a continuous yarn duct with a central cylindrical portion into which the air supply opens and, in the direction of yarn travel, a preferably conical acceleration duct directly adjoining the cylindrical portion with an opening angle ($\alpha_2$) greater than 10°, and an adjoining enlarged portion with an opening angle ($\partial$) greater than 40°, the enlarged portion being designed in the form of a cone or trumpet.

The invention also relates to a nozzle head with a texturing nozzle with a yarn duct which, in the yarn conveying direction, has an inlet portion, a cylindrical central portion with the compressed air supply and an enlarged air accelerating portion and, at the outlet side, a preferably adjustable impact member, and is characterised in that the air accelerating portion has a length ($l_2$) of more than the diameter (d) at the beginning of the acceleration portion and a total opening angle ($\alpha_2$) greater than 10°. The yarn duct is preferably designed with the central portion and the air accelerating portion in a nozzle core which can be fitted and removed.

A further concern of the invention was to improve the quality and/or production rate in an existing apparatus. The solution according to the invention is characterised by the use of a nozzle core as a substitute for an existing nozzle core (or an entire nozzle head with a nozzle core) to increase the production rate and/or to improve the quality of texturing. The nozzle core or the entire nozzle head has identical installation dimensions to the prior art nozzle cores or nozzle heads. The novel substitute nozzle core has an air accelerating portion with a length ($l_2$) of more than 1.5 times the diameter (d) at the beginning of the acceleration duct 11 and a total opening angle ($\alpha_2$) greater than 10°.

Tests carried out hitherto have also shown that moistening of the yarn prior to texturing also produces better results with the novel invention. However, it was not possible conclusively to clarify the influence of the condensation surge known in the specialist sphere.

BRIEF DESCRIPTION OF THE INVENTION

Embodiments of the invention will now be described in detail, by way of example, with reference to the accompanying drawings.

FIG. 3 shows a nozzle core according to the invention as shown in FIG. 2.

FIG. 4 shows a texturing nozzle or a nozzle head with fitted nozzle core in use with quality measurement.

FIG. 4*a* shows the measurement trend of the AT value during a short measurement period.

Figure 5:
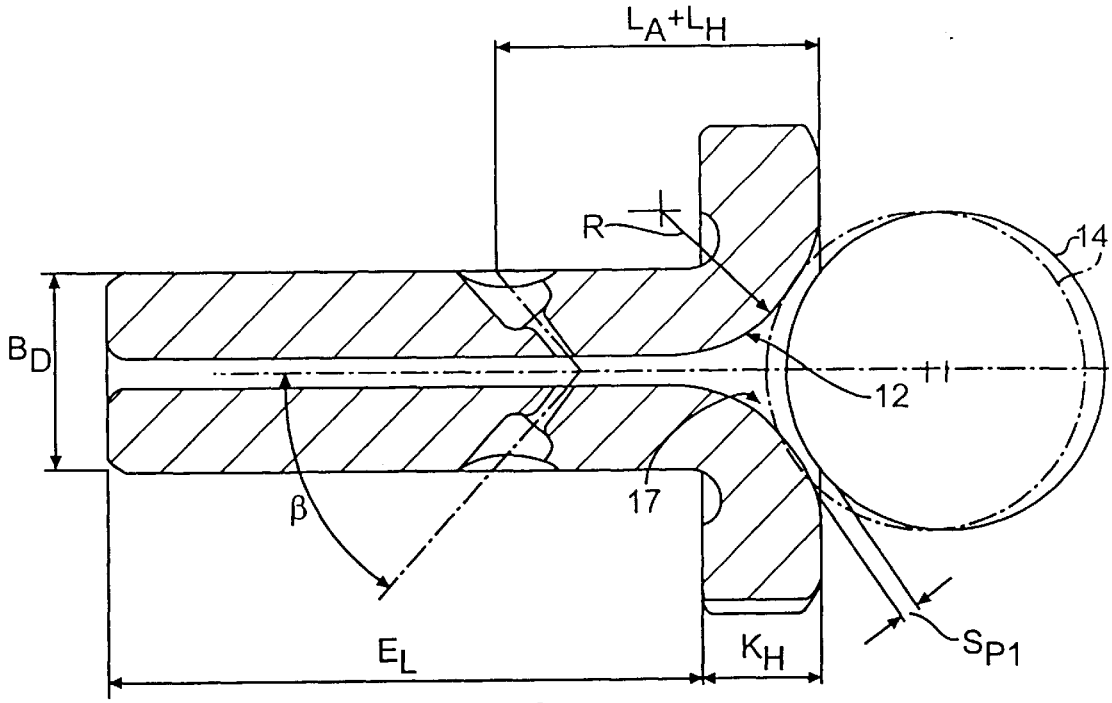
FIG. 5 PRIOR ART

FIG. 5 shows a prior art nozzle core according to EP-PS 88 254.

Figure 6:
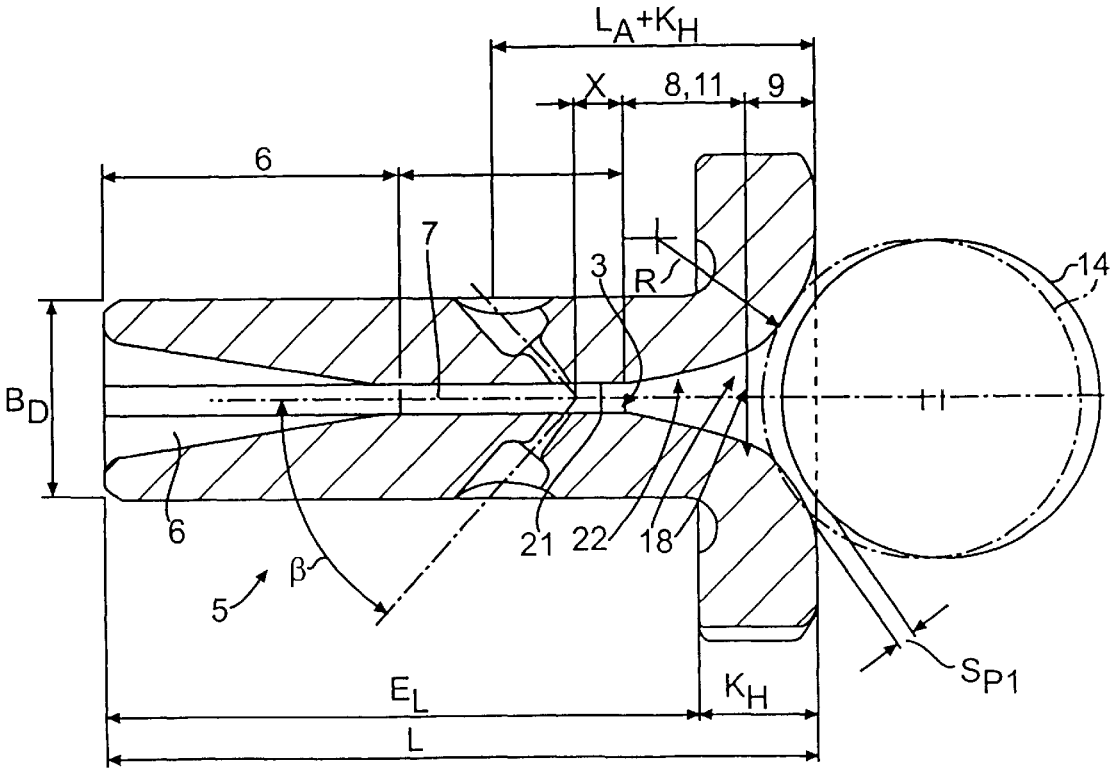
Figure 7D:
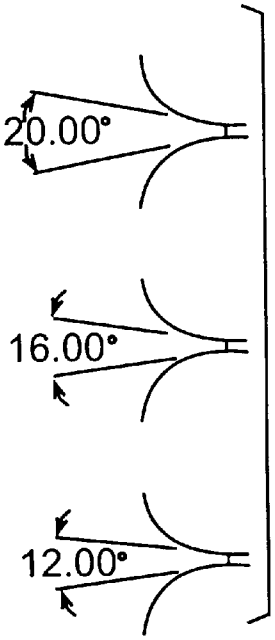
Figure 7C:
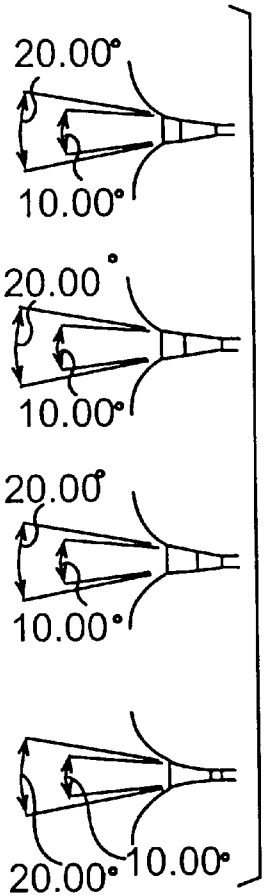
Figure 7B:
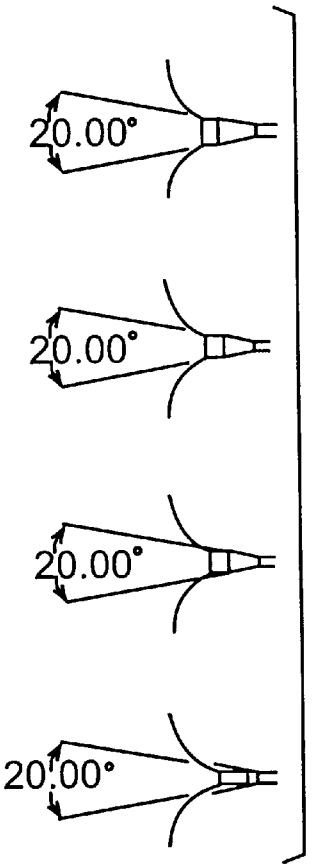
Figure 7A:
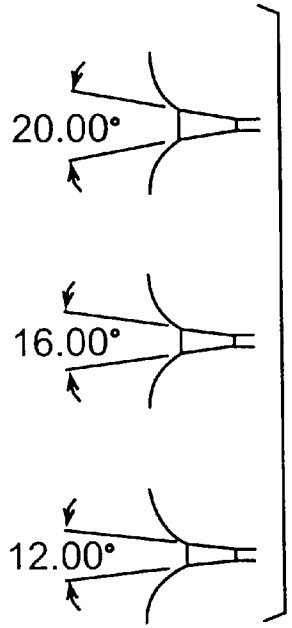
Figure 7G:
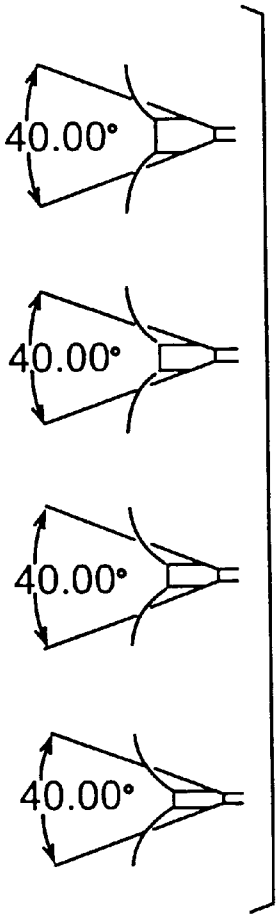
Figure 7F:
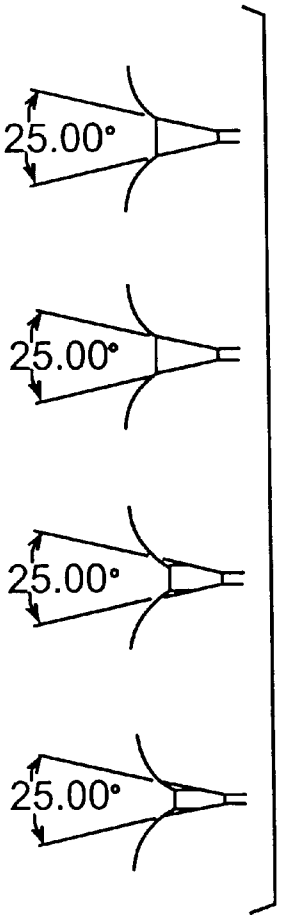
Figure 7E:
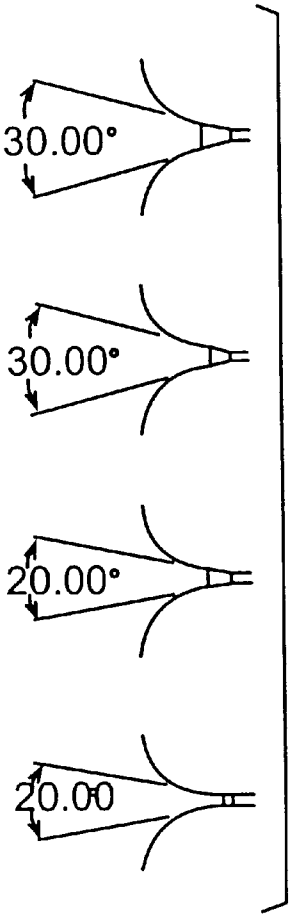

FIG. 6 shows a nozzle core according to the invention with identical external installation dimensions.

FIG. 7 shows some advantageous designs of the acceleration duct according to the invention.

Figure 8:
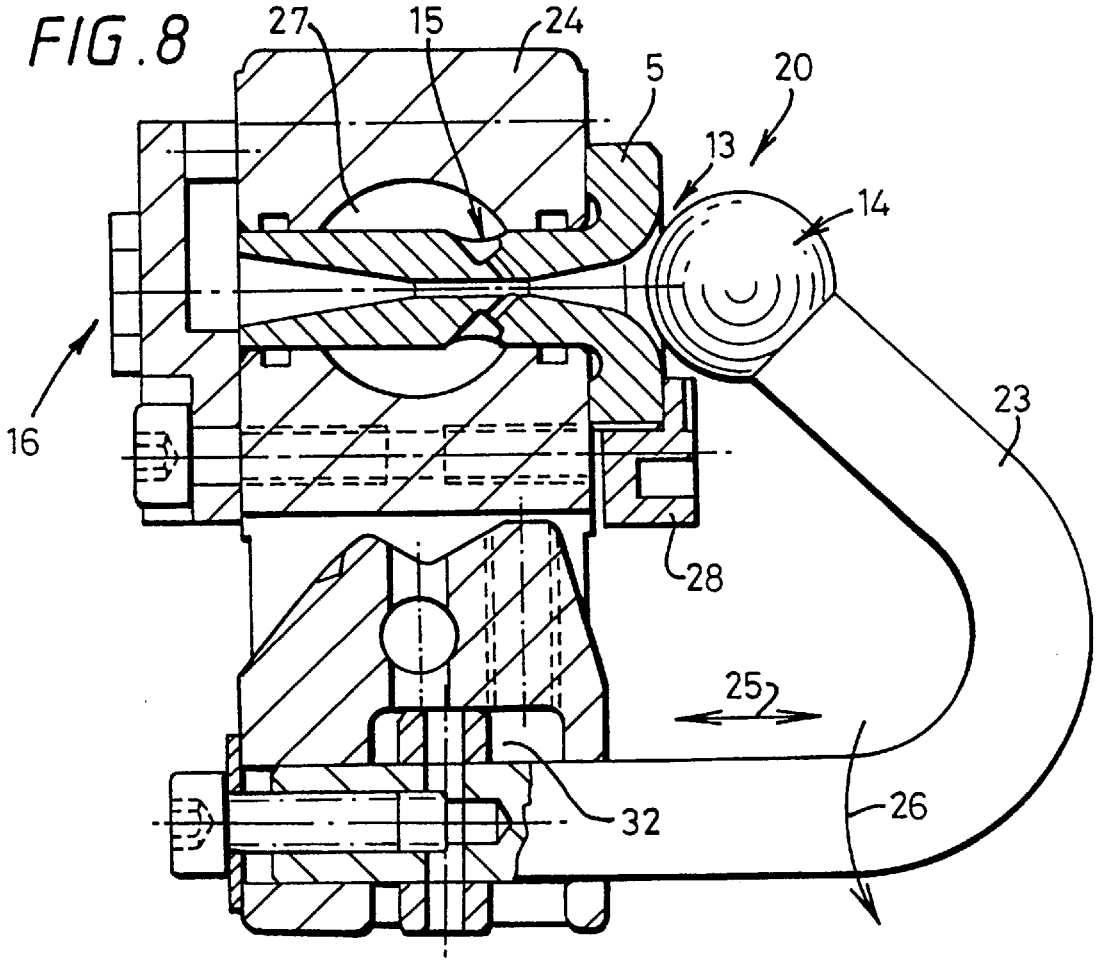

FIG. 8 shows a texturing nozzle or nozzle head partly in section.

Figure 8A:
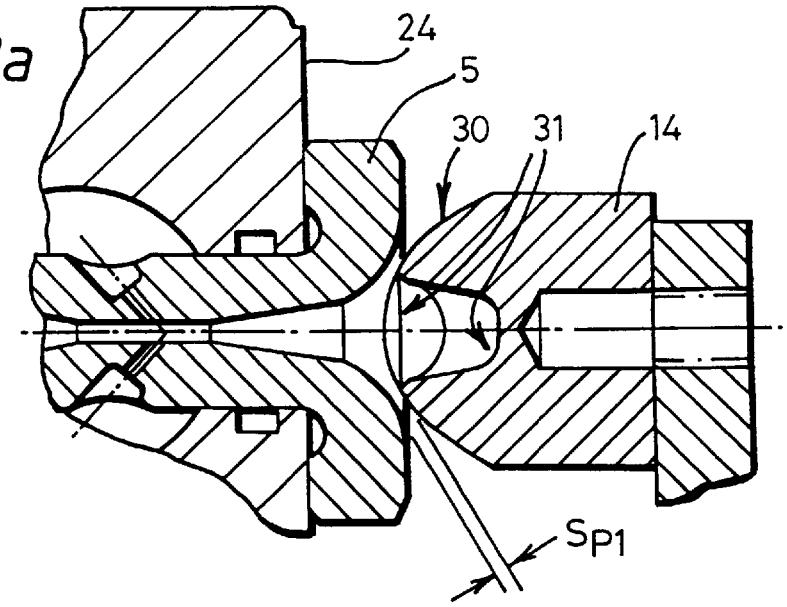

FIG. 8*a* shows a partial magnification of FIG. 8 in the outlet region of the texturing nozzle.

Figure 9:
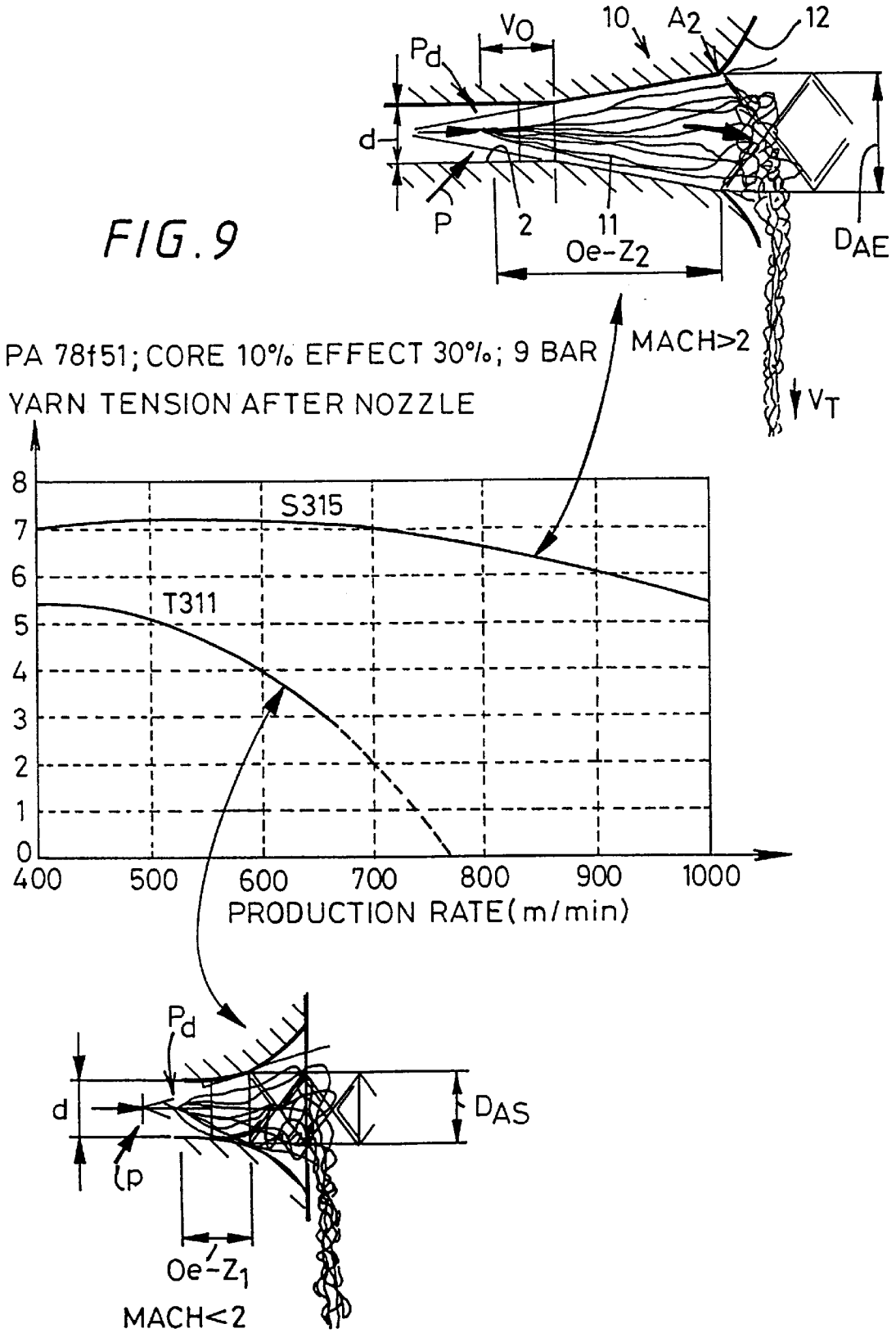

FIG. 9 shows a comparison between textured yarn according to the prior art and according to the novel invention with respect to yarn tension.

FIG. 10 shows quality measurement values in a comparison between the prior art and various nozzles according to the invention in tabular form.

Figures 11, 11A:
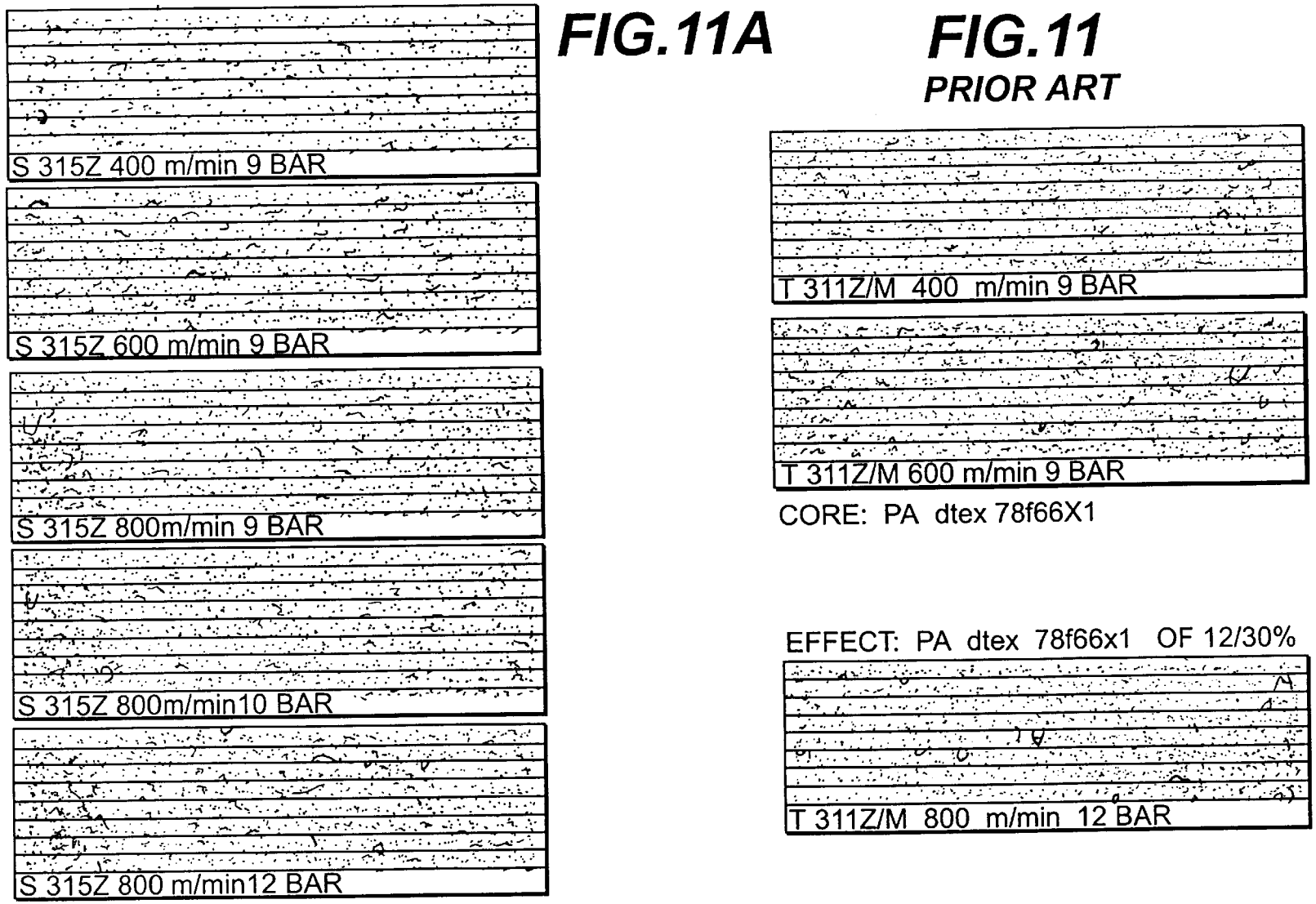
FIG.11 PRIOR ART

FIG. 11 shows comparative photographs of textured yarn, prior art (right).

FIG. 11*a* shows yarn processed according to the invention (left).

FIG. 12 shows a measuring device and comparison measurements, prior art (FIGS. 12*a*/12*b*)/novel invention (FIG. 12*c*).

Figure 13:
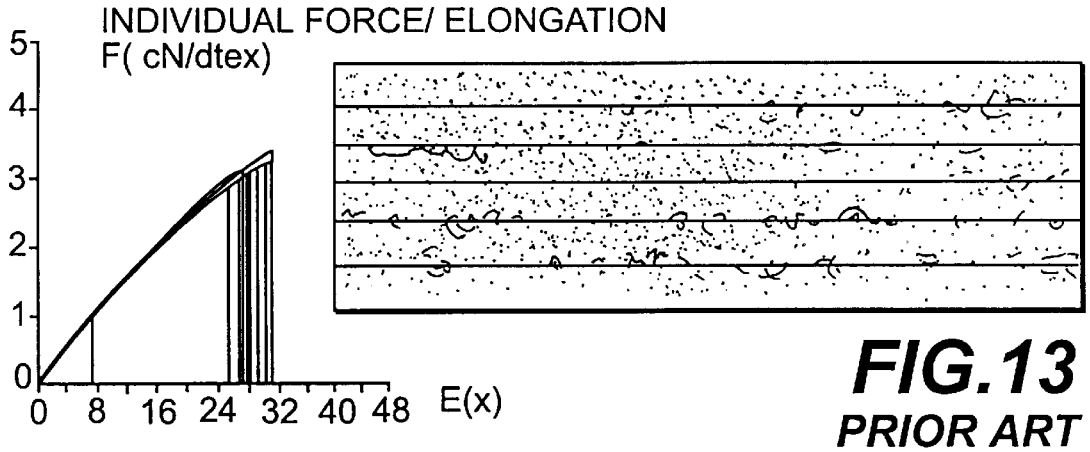
FIG.13 PRIOR ART
Figure 13A:
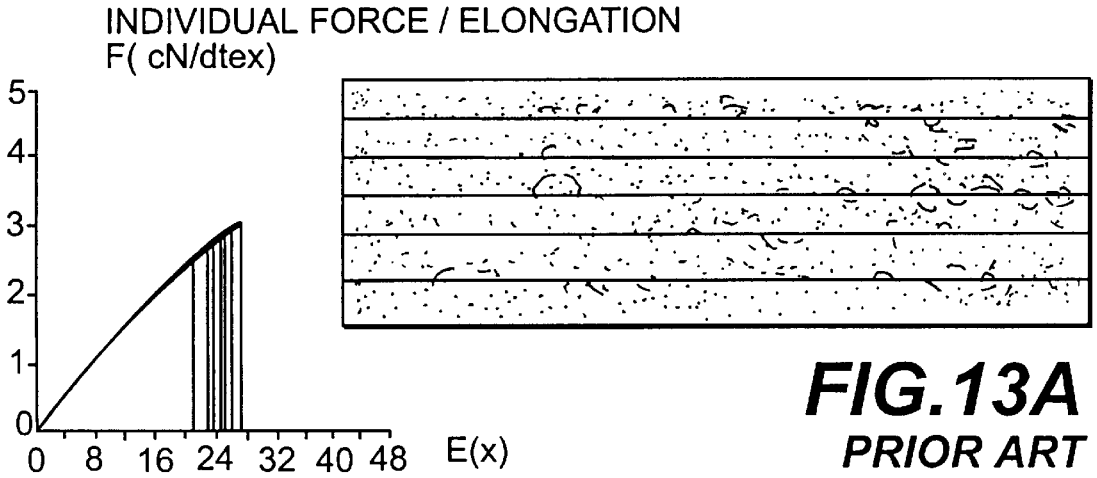
FIG.13A PRIOR ART
Figure 14:
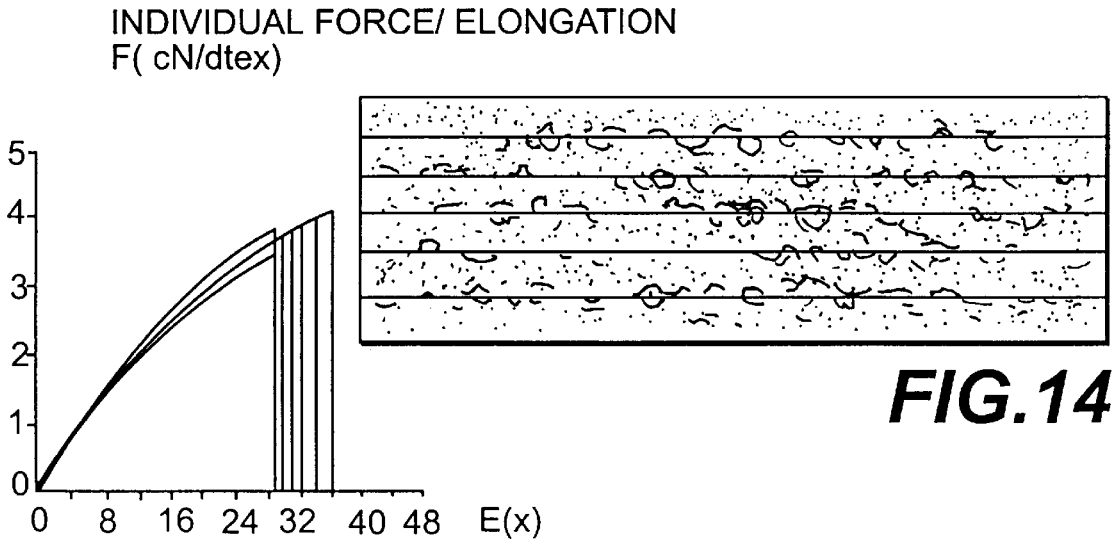

FIGS. 13, 13*a* and 14 show individual force elongation as a comparison between the prior art (FIGS. 13, 13*a*) and novel invention (FIG. 14).

METHODS AND IMPLEMENTATION OF THE INVENTION

Figure 1:
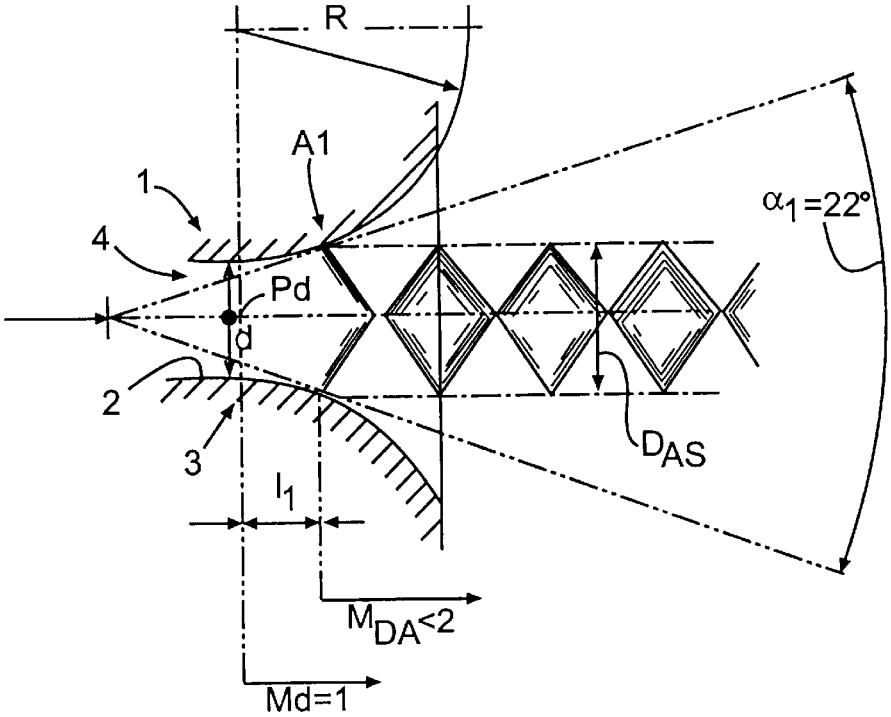
FIG.1 PRIOR ART
FIG. 1 shows the mouth of a prior art nozzle.

Reference will be made hereinafter to FIG. 1 which shows only the region of the nozzle mouth of a known texturing nozzle corresponding to EP-PS 88 254. The corresponding texturing nozzle 1 has a first cylindrical portion 2 which at the same time also corresponds to the narrowest cross section 3 with a diameter d. The yarn duct 4 begins to widen in the form of a trumpet from the narrowest cross section 3, and the shape can be defined by a radius R. A corresponding shock wave diameter $DA_S$ can be determined on the basis of the supersonic flow which is being adjusted. The removal or cessation point which is less great than the internal diameter of the nozzle can be determined relatively exactly on the basis of the shock wave diameter $DA_S$. If a tangent is now applied on both sides in the region of the removal point A, an enveloping cone having an opening angle $\alpha_1$ of about 22° is obtained. This means that the shock wave is removed with an opening angle of 22° with said nozzle shape with a corresponding surface composition. Reference is made to the scientific investigations mentioned at the outset with regard to the features of the shock wave. The acceleration region of the air can also be defined by the length $l_1$ from the point of the narrowest cross section 3 and the cessation point A. As this is a genuine supersonic flow, the air speed can be calculated roughly from it. VDa is the maximum air speed. Vd is the speed of sound at the narrowest point 3. The following values have been calculated in the present example:

$$\frac{DA_S}{d} \cong 1.225;\ \frac{F_A}{F_3} \cong 1.5;\ \frac{l_1}{d} < 1.0;$$

If there is an air speed of 330 m/sec (Mach 1) at Vd, there is an air speed of about Mach 1.8 ($M_{Da}$) at the outlet A from the supersonic region. These values are close to the measured values in the Textile Bulletin. The actual acceleration section within the supersonic duct is very short and, as discovered on the basis of the novel invention, is too short.

Figure 2:
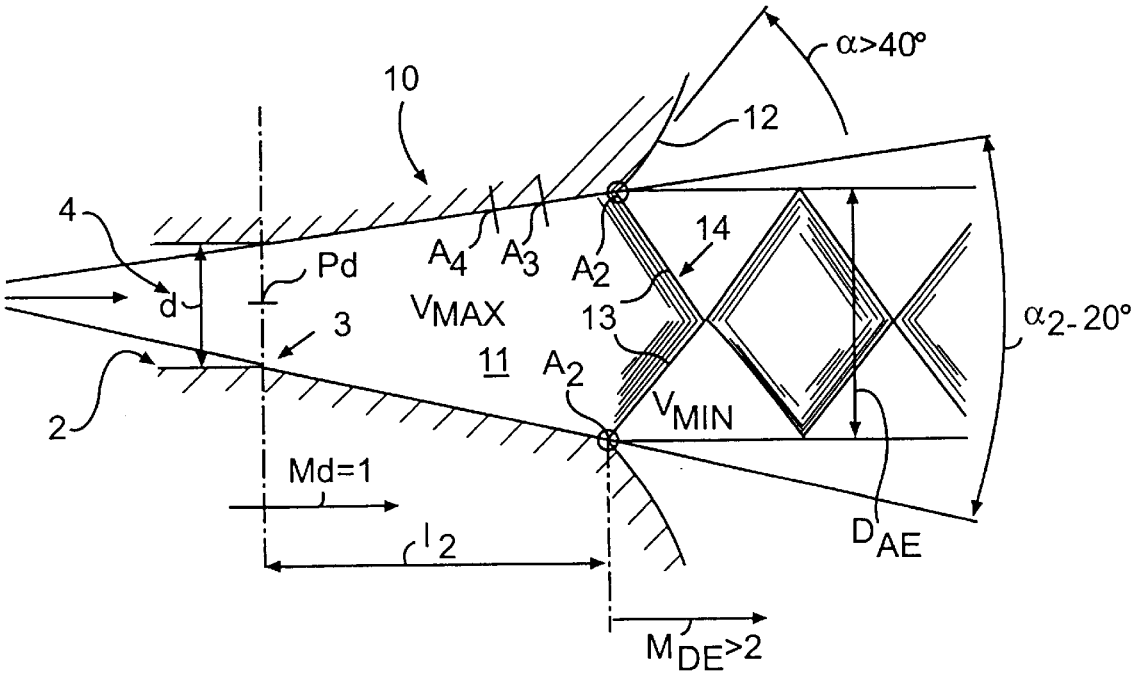
FIG. 2 shows an example of a design of an acceleration duct according to the invention.

FIG. 2 now shows an example of a design of the acceleration duct 11 according to the invention corresponding to the length 12 The texturing nozzle 10 according to the invention is identical to the nozzle core according to FIG. 1 up to the narrowest cross section 3 in the example shown, but then differs. The opening angle $\alpha_2$ is given as 20°. The removal point $A_2$ is shown at the end of the supersonic duct where the yarn duct passes into an unsteady, markedly conical or trumpet-shaped enlargement 12 with an opening angle $\partial$>40°. The geometry produces a shock wave diameter $D_{AE}$ which is substantially greater than in FIG. 1. FIG. 2 yields roughly the following equations:

$$L2/d=4.2;\ Vd=330 \text{ m/sec. (Mach 1)};$$

$$\frac{D_{AE}}{d} \sim 2.5 \rightarrow M_{DE} = \text{Mach } 3.2$$

According to the novel invention, a lengthening of the acceleration duct 11 with a corresponding opening angle increases the shock wave diameter $D_{AE}$. Various investigations have shown that the former assumption, for example according to textile practice, that texturing is a consequence of multiple penetrations of the shock waves by the yarn is at least partially incorrect. The maximum compression shock wave 13 occurs directly in the region of shock wave formation with a subsequent abrupt pressure increase zone 14. Actual texturing takes place in the region of the compression shock wave 13. The air moves faster roughly by the factor 50 than the yarn. It was possible to determine by many experiments that the removal point $A_3$, $A_4$ can also travel into the acceleration duct 11, in particular when the supply pressure is reduced. In practice, the optimum supply pressure has to be determined for each yarn, the length ($l_2$) of the acceleration duct being designed for the most undesirable case, that is rather too long. On the other hand, an increase in the supply pressure in the prior art solution has little effect as the removal point is almost unaffected by the pressure.

Reference will be made hereinafter to FIG. 3 which shows a preferred embodiment of a complete nozzle core 5 in cross section. The outer fitting shape is preferably adapted exactly to the prior art nozzle cores. This applies in particular to the critical installation dimensions, the orifice diameter $B_D$, the total length L, the nozzle head height $K_H$ and the distance $L_A$ to the compressed air connection P. Tests have shown that the former optimum intake angle β can be maintained as can the position of the corresponding compressed air orifices 15. The yarn duct 4 has a yarn inlet cone 6 in the yarn inlet region, arrow 16. The backwardly directed outgoing air flow is reduced by the compressed air directed in the sense of yarn conveyance (arrow 16) via the oblique compressed air orifices 15. The dimension "X" (FIG. 6) indicates that the air orifice is set back preferably at least roughly by the size of the diameter of the smallest cross section 3. When viewed in the conveying direction (arrow 16), the texturing nozzle 10 or the nozzle core 5 has a yarn inlet cone 6, a cylindrical central portion 7, a cone 8 which simultaneously corresponds to the acceleration duct 11, and an enlarged texturing chamber 9. The texturing chamber is limited transversely to the flow by a trumpet shape 12 which can also be designed as an open conical funnel.

FIG. 4 shows a complete texturing head or nozzle head 20 with installed nozzle core 5. The unprocessed yarn 21 is supplied to the texturing nozzle via a delivery mechanism 22 and is forwarded as textured yarn 21'. An impact member, or baffle member 14 is located in the outlet region 13 of the texturing nozzle. A compressed air connection 27' is arranged laterally on the nozzle head 20. The textured yarn 21' travels at a conveying speed VT via a second delivery mechanism 22. The textured yarn 21' is guided via a quality sensor 26, for example with the trade name HemaQuality, known as ATQ, in which the tensile force of the yarn 21' (in cN) and the deviation of the instantaneous tensile force (sigma %) are measured. The measurement signals are supplied to a computer 70. The corresponding measurement of quality is a condition for the optimum monitoring of production. However, the values are also mainly a gauge of yarn quality. Quality determination is particularly difficult in the air jet texturing process as there is no defined loop size. It is much better to determine the deviation from the quality found by the customer to be good. This is possible with the ATQ system because the yarn structure and the deviation thereof can be evaluated via a yarn tension sensor 26 and can be displayed by a single characteristic, the AT value. A yarn tension sensor 26 detects, in particular, the tensile force of the yarn after the texturing nozzle as an analog electric signal. The AT value is determined continuously from the mean value and variance of the measured values of the tensile force of the yarn. The magnitude of the AT value is dependent on the structure of the yarn and is determined by the user according to his own quality requirements. If the tensile force of the yarn or the variance (uniformity) of the yarn tension varies during production, the AT value also varies. The position of the upper and lower limit values can be determined by yarn levels and samples of knit or woven fabric. They differ according to quality requirements. The quite particular advantage of ATQ measurement is that various interruptions due to processing can be detected simultaneously. For example, regularity of texturing, yarn moistening, filament breakages, nozzle contamination, impact member distance, hot pin temperature, air pressure differences, POY insertion zone, yarn presented, etc. FIG. 4*a* is a chart of the trend of the AT value over a short measuring time.

FIGS. 5 and 6 show nozzle cores magnified several times in comparison with the actual size. FIG. 5 shows a nozzle core according to the prior art and FIG. 6 a nozzle core according to the invention. As it was possible with the novel invention to achieve the object in the interior of the nozzle core so to speak, the novel nozzle core could be designed as a replacement core for the former one. In particular, the dimensions $B_d$, $E_L$ as installation length, $L_A$ plus $K_H$ and $K_H$ are therefore preferably not only equal but also produced with the same tolerances. Furthermore, the trumpet shape is preferably also produced identically in the external outlet region to the prior art with a corresponding radius R. The impact member can be of any shape: spherical, flat ball shaped or even in the form of a cap (FIG. 8*a*). The exact position of the impact member in the outlet region is retained by maintaining the external dimensions, corresponding to an identical take-off gap $S_{p1}$. The texturing chamber 18, which is designated by 17 in FIG. 5, remains externally unchanged, but is now directed backwardly and defined by the acceleration duct 11 according to the invention. The texturing chamber can also be enlarged into the acceleration duct, depending on the value of the selected air pressure, as indicated by two arrows 18 in FIG. 6. As in the prior art, the nozzle core is produced from a high quality material such as ceramic, hard metal or special steel and is actually the expensive part of a texturing nozzle. It is important with the novel nozzle that the cylindrical wall surface 21 as well as the wall surface 22 is of optimum quality in the region of the acceleration duct. The constitution of the trumpet enlargement is determined with regard to yarn friction.

FIG. 7 shows supersonic ducts of various designs. In some cases, only the opening angle for a portion of the supersonic duct is indicated. Contrary to all expectations, the test results between the variations were not very great. Purely conical acceleration ducts with an opening angle of between 15 and 25° (far left of diagram) proved to be the best shapes. The vertical column a shows pure cone shapes, rows b and c a combination of cone shape and short cylindrical portions whereas row d has a paraboloid acceleration duct. Row c shows a combination of cone and trumpet shapes. In rows f and g, the first portion of the acceleration duct is markedly enlarged and then passes into a cylindrical part. Tests with all types have yielded very good results, the best results formerly having been determined with rows a and d. It is not unimportant for comprehension that the central cylindrical portion has a diameter in the millimeter range or even smaller than 1 mm. The length of the acceleration portion lies in the range of about 1 cm or smaller.

FIG. 8 shows a complete nozzle head 20 with a nozzle core 5 and an impact member, or baffle member, 14 which is adjustably secured in a known housing 24 via an arm 23. For threading purposes, the impact member, or baffle member, 14 is drawn or pivoted away from the working region 13 of the texturing nozzle in a known manner according to arrow 25 with the arm 23. The compressed air is supplied from a housing chamber 27 via compressed air orifices 15. The nozzle core 5 is firmly clamped on the housing 24 via a clamping member 28. Instead of a ball shape 30, the impact member can also have a cap shape 31. FIG. 8*a* shows the combination of a texturing nozzle according to the invention with variations of the shape of the impact member, or baffle member, 14, in the form of a ball. The impact member 14 easily penetrates the trumpet-shaped aperture in the nozzle. A normal working position is shown in a solid line in FIG. 6 and the impact ball touching the trumpet shape 12 in a dot-dash line. The dot-dash position can be used as a starting position for the exact location in the working position. An internal texturing chamber 18 is produced on the one hand by the trumpet shape 12 and on the other hand by the impact member 14, and a free gap $Sp_1$ is available for the outgoing texturing air and for leading out the textured yarn. The gap $Sp_1$ is determined, optimised and established for production empirically in each case on the basis of the yarn quality. The configuration and size of the texturing chamber 18 can therefore be influenced according to ball diameter and impact member configuration. It has been found by the inventor that the pressure conditions for the acceleration duct could be influenced primarily with the size of the take-off gap. The flow resistance and the static pressure in the texturing chamber are changed by a reduction in the take-off gap $Sp_1$. Changes in the gap width of the order of tenths of a millimetre determine the pressure adjustment. Circular cross sections and supersonic ducts designed symmetrically in a longitudinal section have been used in each case for former tests. However, the novel solution can also be designed for cross sections which are asymmetrical and differ from a circular shape with respect to the supersonic duct, for example with a rectangular cross section and with substantially rectangular or substantially oval shapes. It is also possible to design a nozzle which is split in such a way that it can be opened for threading in purposes. Reference is made to international application PCT/CH96/00311, which is described as an integral part of the present application with regard to the technical content.

The bottom left-hand corner of FIG. 9 shows the prior art texturing purely schematically. Two main parameters are emphasised. An opening zone Oe-$Z_1$ and a shock wave diameter DAs, starting from a diameter d corresponding to a nozzle of the type shown in FIG. 1. On the other hand, the novel method of texturing is shown in the top right-hand corner. It can be seen very clearly that the values Oe-$Z_2$ as well as $D_{AE}$ are considerably greater. A further interesting aspect was also noticed. The opening of the yarn begins before the acceleration duct in the region of the compressed air supply P, that is in the cylindrical portion designated by VO as preliminary aperture. The dimension Vo is preferably selected greater than d. The importance of FIG. 9 lies in the diagrammatic comparison of the yarn tension according to the prior art (curve T 311) with Mach<2 and a texturing nozzle according to the invention (curve S 315) with Mach>2. Curve 311 shows the clear collapse of the yarn tension over a production rate of 500 m/min. Texturing broke down above about 650 m/min. On the other hand, curve S 315 with the nozzle according to the invention shows that the yarn tension is not only much higher but is almost constant in the range of 400 to 700 m/min and only falls slowly even in the higher production range. The increase in the Mach number is one of the most important "secrets" for progress with the novel invention.

FIG. 10 shows a printout of ATQ quality examination. The top table shows the average tensile stress (cN), the middle table the percentage deviation from the instantaneous tensile force (sigma %) and the bottom table the corresponding AT values. The respective values of a standard nozzle, that is of a prior art texturing nozzle, are given in the first horizontal line of each table. The values of S nozzles according to the invention with different opening angles from 19 to 30.6° are then given from top to bottom. All nozzles according to the invention had the same length of supersonic duct. The values 0.00 indicate either that texturing was not possible or that the experiment was not carried out. FIGS. 11 and 11*a* show a visual comparison with reference to textured yarn. FIG. 11 (right half of diagram) shows texturing with a prior art nozzle at production rates of 400, 600 and 800 m/min. The pressure was also increased to 12 at 800 m/min. The result can be described as good up to 400 m/min and as fairly good at 600 m/min. The results of five tests on a nozzle according to the invention are accordingly shown on the left half of the diagram (FIG. 11*a*). It can be seen that a fairly good result is still obtained even at a production rate of 800 m/min. On the other hand, the comparison example (on its right) according to the prior art was rejected by the customer even though a supply pressure of 12 bar had been employed.

Following from FIG. 11, FIGS. 12*a* and 12*b* as well as 12*c* show a tabular comparison of the adjustment and measurement data. FIGS. 12*a* and 12*b* (left) correspond to the state of the art and FIG. 12*c* shows the results with the novel invention (right).

Similar statements can also be inferred from FIGS. 13, 13*a* and 14. A respective graph of a plurality of filaments with the individual force F (vertical) over the elongation (horizontal) in each case is shown on the left of the diagram. FIG. 13 refers to FIGS. 12*a,* FIG. 13*a* to 12*b* and FIG. 14 to FIG. 12*c*.

The novel invention has produced many surprising effects with a relatively small measure, in particular by the design according to the invention of the acceleration duct region. This allows, for example:

a nozzle core according to the invention to be installed instead of a prior art nozzle core without any alterations to the other processing parameters, resulting in a quality which is more stable and better;

or if the customer wishes to increase the production rate slightly: the installation of a novel nozzle core allows the production rate to be increased without losses of quality;

or if the customer wishes to increase the production rate markedly: the quality can also be ensured by increasing the air supply pressure;

either only the nozzle core or the complete nozzle head can be replaced in each case.

What is claimed is:

1. A method for the aerodynamic texturing of yarn with a texturing nozzle having a continuous yarn duct, at one end of which the yarn is supplied and at the other end is delivered as textured yarn, the method comprising the steps of supplying compressed air into a central portion of the yarn duct, accelerating the air to supersonic speed higher than Mach 2 in a widening acceleration duct portion of the yarn duct proximate said other end, wherein at a predetermined supply pressure of the compressed air higher than 4 bar, a substantially constant yarn tension is achieved for a given yarn quality and a production rate of 400 to 600 m/min.

2. The method of claim 1, wherein the predetermined supply pressure of the compressed air is between approximately 6 bar and approximately 14 bar.

3. The method according to claim 1, wherein the compressed air in the acceleration duct portion is accelerated over a length of at least 1.5 times a narrowest diameter of the yarn duct and wherein the ratio of an outlet cross section to an inlet cross section of the corresponding duct portion is greater than 2.

4. The method according to claim 1, including an initial step of providing the acceleration duct portion with a total opening angle greater than 10 degrees.

5. The method according to claim 1, wherein the acceleration of the air takes place progressively and with non-uniform acceleration.

6. The method according to claim 1, wherein the compressed air is guided from a supply position into the yarn duct in an axial direction at substantially constant speed to the acceleration duct portion, the compressed air being introduced into the yarn duct via one or more orifices at an angle having a conveying component in the direction of the acceleration duct portion.

7. The method according to claim 1, wherein the compressed air is guided to the acceleration duct portion without deflection through a widening yarn duct portion.

8. The method according to claim 1, wherein one or more yarn filaments are supplied at said one end with excess delivery and are textured at a production rate of approximately 400 to approximately 1500 m/min.

9. The method according to claim 1, wherein the compressed air is accelerated in the widening acceleration duct portion to between approximately 2.0 Mach and approximately 6 Mach.

10. The method according to claim 1, wherein an outlet end of the yarn duct is limited by a baffle member forming a gap, the method further including the step of delivering the textured yarn through the gap substantially at right angles to a yarn duct axis.

11. A texturing nozzle for yarn comprising a continuous yarn duct with an outlet end having an acceleration duct proximate thereto, a compressed air supply inlet (P) in a central portion of the yarn duct, an inlet end to which yarn can be supplied, textured yarn being taken off at said outlet end, wherein the central portion and an inlet region of the acceleration duct is substantially cylindrical, and the compressed air supply inlet is angled in the direction of the outlet end and operating by a radial principle, an accelerating portion of the acceleration duct has a length greater than 1⅓ times a diameter (d) at the beginning of the acceleration duct and a total opening angle greater than 10 degrees, and is sized to provide acceleration of the air to greater than approximately Mach 2.

12. The texturing nozzle according to claim 11, wherein the acceleration duct is conical in design and has a total opening angle of between approximately 10 degrees and approximately 40 degrees.

13. The texturing nozzle according to claim 11, wherein the acceleration duct has at least one cross-sectional enlargement ratio of the outlet end to the inlet end of greater than 2.

14. The texturing nozzle according to claim 12, wherein the acceleration duct is conical in design and passes into an enlarged trumpet-shaped aperture.

15. The texturing nozzle according to claim 12, wherein the length of the acceleration duct is at least two times greater than the diameter (d) of the yarn duct at a beginning of the acceleration duct.

* * * * *

UNITED STATES PATENT AND TRADEMARK OFFICE

CERTIFICATE OF CORRECTION

PATENT NO. : 6,088,892
DATED : July 18, 2000
INVENTOR(S) : Gotthilf Bertsch et al.

It is certified that error appears in the above-identified patent and that said Letters Patent is hereby corrected as shown below:

Claim 11, column 12,
Line 41, "greater than 1 1/1" should read -- greater than 1½ --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*